United States Patent [19]

Barry

[11] 4,365,809

[45] Dec. 28, 1982

[54] THREE-FIGURE DISSECTION PUZZLE

[76] Inventor: Dixie B. Barry, 3850 Atlantic Ave., Space 184, Highland, Calif. 92346

[21] Appl. No.: 241,480

[22] Filed: Mar. 9, 1981

[51] Int. Cl.[3] ..... A63F 9/10
[52] U.S. Cl. ..... 273/157 R
[58] Field of Search ..... 273/157 R

[56] References Cited

U.S. PATENT DOCUMENTS 1,657,736 1/1928 Bishop ..... 273/157 R
3,178,186 4/1965 Lee ..... 273/157 R

OTHER PUBLICATIONS

"Geometrical Dissections" by Harry Lindgren, ©1964, published by Dover Publications, Inc., New York, pp. 7 and 31.

*Primary Examiner*—Anton O. Oechsle
*Attorney, Agent, or Firm*—Christie, Parker & Hale

[57] ABSTRACT

There is provided a puzzle of nine basic geometric pieces, alternatively assemblable into a rectangle, square or five-pointed star, the nine pieces being subdividable and in their largest form being three right triangles, four isosceles triangles, and two quadrilaterals.

5 Claims, 3 Drawing Figures

THREE-FIGURE DISSECTION PUZZLE

BACKGROUND OF THE INVENTION

The present invention is directed to a puzzle providing pleasure or psychological testing utilities, and in particular to a puzzle, the parts thereof which are assemblable into a plurality of recognizable shapes.

SUMMARY OF THE INVENTION

There is provided in accordance with the present invention a unique arrangement of geometric pieces which form when assembled a square, rectangle or five-pointed star. The basic construction consists of nine polygons which may be subdivided to increase the number of pieces and, therefore, the puzzle complexity. The nine basic pieces consist of three right triangles, four isosceles triangles and two quadrilaterals.

THE DRAWINGS

DETAILED DESCRIPTION

The present invention pertains to a puzzle in which a multiplicity of geometric shapes are combinable to form three separate and distinct known geometric forms, in particular a rectangle, a square and a five-pointed star.

In the presently preferred embodiment of the invention, nine polygons are used. It would be appreciated, however, to one of ordinary skill in the art that any one of the polygons can be subdivided into other pieces, including polygons. Nine polygons, however, form a sufficient obstacle to solution to warrant basic interest in completion of the puzzle as well as the use of the arrangement of polygons for evaluation of aptitudes.

Figure 1:
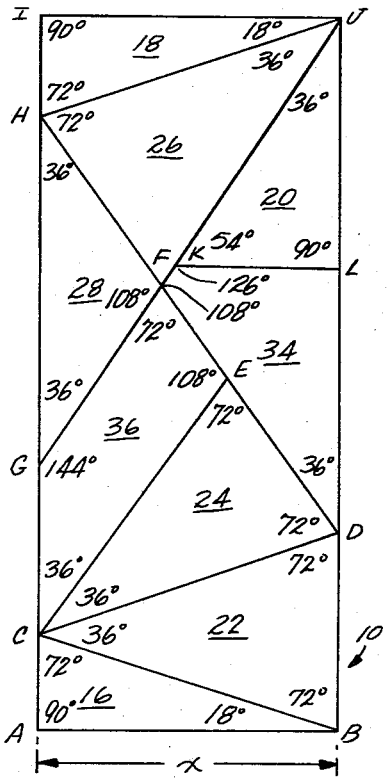
FIG. 1 shows the interrelationship of the nine polygons of the invention in forming a rectangle.
Figure 2:
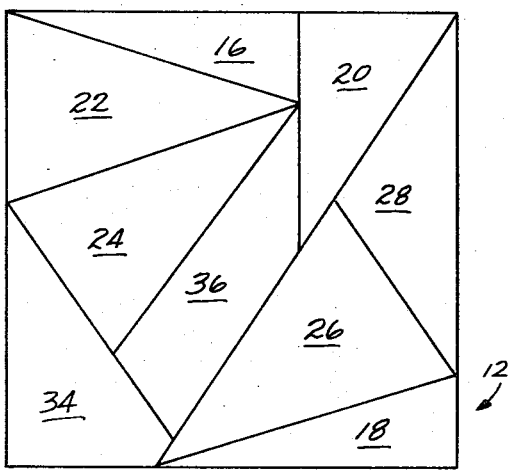
FIG. 2 shows the interrelationship of the same polygons in forming a square.
Figure 3:
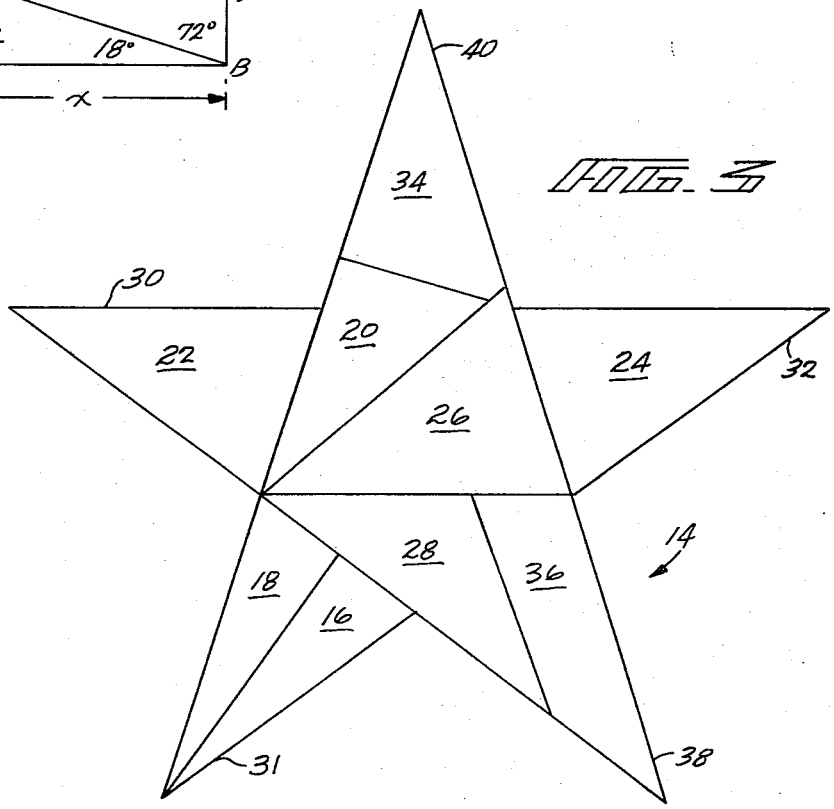
FIG. 3 shows the interrelationship of the same polygons in forming a regular, five-pointed star.

With reference to FIGS. 1, 2 and 3, the final shapes are rectangle 10, square 12 or five-pointed star 14. Two bases of rectangle 10 are sides AB and IJ of mirror-image right triangles 16 and 18. With reference to side AB or IJ having a length x, the length of sides AC and IH are about 0.31x and hypotenuse BC and JH are about 1.05x. The included angles are about 18° for ABC and IJH, about 72° for angles ACB and IHJ, and 90° for angles CAB and HIJ. Sides AB and IJ form the narrower sides of rectangle 10, and mate to form point 31 of star 14 and portions of edges of square 12.

The next basic geometric figures are isosceles triangles 22, 24, 26 and 28. Triangles 22 and 24 are identical and have side CB, CD and CE equal to the hypotenuse of triangles 16 and 18 and a base equal to about twice AC. Angles BCD and DCE are about 36°, while angles CBD, CDB, CDE and CED are about 72°. The angles of triangle 26 are about the same as 22 and 24. The triangle is, however, larger; namely, HF is about 0.68x, while legs FJ and HJ are about 1.06x. Triangles 22 and 24 form points 30 and 32 of five sided star 14.

Isosceles triangle 28 has a base HG, which is about 1.17x and sides HF and GF, which are about 0.688x. Angles GHF and HGF are each about 36°, while angle HFG is about 108°.

The final elements are quadrilaterals, or four-sided figures 34 and 36. Quadrilateral 34 is formed of angle FKL of about 126°, KLD of 90°, LDF of about 36° and DFK of about 108°. Side FK is about 0.09x, KL is about 0.53x, and LD is about 0.87x. DF is about equal to x. Quadrilateral 36 is formed of angles GCE of about 36°, CEF of about 108°, EFG of about 72°, and FGC of about 144°. Side CG is about 0.5x, GF about 0.68x, FE about 0.34x, and CE about 1.05x. Sides GC and CE, which include angle GCE, form part of point 38 of star 14, while 34 forms part of point 40 of star 14.

Any of the nine basic elements which combine to form the star, rectangle or square of the instant invention may be subdivided into other parts. For instance, isosceles triangles 22, 24, 26 and 28 may be readily and conveniently subdivided into right triangles without detracting from the ability of forming the net structures and adding only to the difficulty of the task. Quadrilaterals 34 and 36 can be divided into triangles and quadrilaterals.

I have found, however, that the nine basic elements shown form a puzzle of sufficient complexity, so much so that it is preferred that the opposed surfaces differ to prevent a piece from being attempted to be placed in position turned over.

The basic structural elements which form the puzzle of the invention may be formed of plastic, wood, cardboard and the like. Where wood is used, different grains are used on each side in order for the user to enjoy side differentiation. To further add to the convenience of assembly, there may be provided frames into which the pieces are assembled. The frames may be singular to form a common board, or separate for each of the three geometric shapes, these shapes being the square, the rectangle and the five-pointed star. While typically "planar" or flat, the geometric pieces or elements may be of three-dimensional relief to assist in simplifying assembly and/or adding esthetic appeal.

What is claimed is:

1. A puzzle comprising a plurality of basic geometric pieces shaped to be combinable to form, alternatively, a rectangle, square or five-pointed star, said basic pieces being three right triangles, four isosceles triangles and two quadrilaterals, which pieces being subdividable to increase the number of pieces combined to form, alternatively, said rectangle, square or five-pointed star.

2. A puzzle as claimed in claim 1 in which two of the right triangles are identical in dimension and mirror images of each other.

3. A puzzle as claimed in claim 2 in which two of the isosceles triangles are identical in dimension.

4. A puzzle as claimed in claim 3 in which three of the isosceles triangles have substantially equal angles.

5. A puzzle comprising nine subdividable geometric pieces combinable to form a rectangle, square and a five-pointed star, said pieces being;

(a) a first right triangle having included angles about 18°, about 72° and 90°, a hypotenuse, and a longer of two sides of a length x wherein x is equal to a shorter side of the rectangle;

(b) a second right triangle which is the mirror image of the first right triangle;

(c) a third right triangle having the included angles of about 36°, about 54° and 90°, and a shortest of two sides with a length of about 0.53x;

(d) a first isosceles triangles having included angles of about 36°, about 72° and about 72°, the length of the sides including the angle of about 36° being equal to the hypotenuse of said first triangle;

(e) a second isosceles triangle substantially identical to the first isosceles triangle;

(f) a third isosceles triangle having angles of about 36°, about 72° and about 72°, and having two sides of a length of about 1.06x;

(g) a fourth isosceles triangle having angles of about 36°, about 36° and about 108°, and a base of about 1.18x;

(h) a first quadrilateral having successive peripheral included angles of 90°, about 36°, about 108° and about 126°, and where the sides forming the 90° angle are about 0.53x and about 0.87x and a side forming, with the side of length 0.87x the angle of about 36°, a length equal to x; and (i) a second quadrilateral having successive peripheral included angles of about 36°, about 144°, about 72° and about 108°, and in which the angle of about 36° is formed by intersection of sides having a length equal to the hypotenuse of said first right triangle and about 0.5x.

* * * * *